US008602944B2

(12) United States Patent
Fleitz

(10) Patent No.: US 8,602,944 B2
(45) Date of Patent: Dec. 10, 2013

(54) WING CHUN DUMMY CONTROLLER

(76) Inventor: Zachary Fleitz, Georgetown, NY (US)

( * ) Notice: Subject to any disclaimer, the term of this patent is extended or adjusted under 35 U.S.C. 154(b) by 44 days.

(21) Appl. No.: 12/835,728

(22) Filed: Jul. 13, 2010

(65) Prior Publication Data

US 2011/0015040 A1 Jan. 20, 2011

Related U.S. Application Data

(60) Provisional application No. 61/225,421, filed on Jul. 14, 2009.

(51) Int. Cl.
*A63B 71/00* (2006.01)
*A63B 69/34* (2006.01)

(52) U.S. Cl.
USPC ..... 482/8; 482/83

(58) Field of Classification Search
USPC ..... 482/8, 36, 83–90; 463/8
See application file for complete search history.

(56) References Cited

U.S. PATENT DOCUMENTS 3,804,406 A * 4/1974 Viscione ..... 482/4
4,401,303 A * 8/1983 Anderson et al. ..... 482/4
5,941,801 A * 8/1999 D'Alto ..... 482/90
6,110,079 A * 8/2000 Luedke et al. ..... 482/83
6,302,831 B1 * 10/2001 Henry ..... 482/83
6,808,477 B2 * 10/2004 Tudor ..... 482/83
6,872,171 B2 * 3/2005 Haselrig ..... 482/83
6,994,658 B2 * 2/2006 Laudenslager et al. ..... 482/83
7,131,936 B2 * 11/2006 Schlosser ..... 482/69
7,416,517 B2 * 8/2008 Mitchell ..... 482/90
7,678,029 B2 * 3/2010 Ng ..... 482/90
7,758,476 B2 * 7/2010 Chu ..... 482/86
7,794,370 B2 * 9/2010 Tackett ..... 482/83
7,938,759 B1 * 5/2011 Gaynor ..... 482/83
2005/0209066 A1 * 9/2005 Penney ..... 482/84
2005/0288159 A1 * 12/2005 Tackett ..... 482/84
2007/0142186 A1 * 6/2007 Macnab ..... 482/83
2008/0076636 A1 * 3/2008 Smith ..... 482/1
2008/0254950 A1 * 10/2008 Beliles ..... 482/83
2011/0172060 A1 * 7/2011 Morales et al. ..... 482/8

* cited by examiner

*Primary Examiner* — Oren Ginsberg
*Assistant Examiner* — Shila Jalalzadeh Abyane
(74) *Attorney, Agent, or Firm* — Richards Patent Law P.C.

(57) ABSTRACT

A Wing Chun dummy including a plurality of transducers associated with the dummy, wherein a physical impact to the dummy activates at least one of the transducers to generate an output signal. In another example a device includes a body; a plurality of appendages; and a plurality of transducers associated with the appendages wherein the plurality of transducers are located such that a physical impact to any of the appendages activates at least one transducer to generate an output signal further wherein, different output signals are generated based on the direction of the impact to each appendage.

19 Claims, 2 Drawing Sheets

WING CHUN DUMMY CONTROLLER

CROSS-REFERENCE TO RELATED APPLICATIONS

This application incorporates by reference and claims priority to U.S. Provisional Patent Application No. 61/225,421 filed Jul. 14, 2009.

BACKGROUND OF THE INVENTION

The present invention relates to a Wing Chun dummy. More specifically, the present invention relates to a Wing Chun dummy adapted for use as an electronic control device.

The genesis of the martial arts is commonly attributed to the need for self-defense, hunting techniques and military defense. One style of martial arts is Wing Chun. Wing Chun consists of six forms all of which embody the characteristics of balance, structure, stance and flexibility. One form of Wing Chun utilizes a Muk Yan Jong ("Wing Chun dummy"). A Wing Chun dummy is a wooden device used during Wing Chun training. Although various forms of the martial arts use a Muk Yan Jong, the Wing Chun wooden dummy is the most popular form.

The Wing Chun dummy uses an arm and leg configuration which is designed to cultivate fighting skills. Having three arms and one leg, the Wing Chun dummy represents an opponent's body in various positions and the lines of force that the body can exert. The dummy itself and its arms and legs may be secured such that they exhibit a reactionary force which is similar to a human opponent's involuntary reaction when struck. For example, the dummy may be suspended on a rack or bolted to a wall for stability.

Although the martial arts are rooted in physical defense, the martial arts have a significant performance art aspect as well. Many types of performance arts are rooted in the martial arts including the Kabuki theater of Japan and the Brazilian art of capoeira.

Piezoelectric sensors convert forces exerted thereon into electric signals. The electric signals may then be used to control associated electronics, such as, for example sound and/or light modules. The advent of piezoelectric sensors has enabled otherwise non-electrical devices to be adapted to produce an electrical output signal.

Accordingly, it may be advantageous to provide a Wing Chun dummy adapted for use as an electronic controller in the performance arts.

SUMMARY OF THE INVENTION

The subject matter addressed herein addresses these issues by providing a device that may be used to practice the martial arts while simultaneously creating an electrical output. The device allows the user to covert his physical action into an electrical signal which may be used to control a visual and/or audio display.

In one contemplated embodiment, the device includes a Wing Chun dummy and a plurality of piezoelectric transducers. Physical impact to the dummy may activate one or more of the transducers, which generates an output signal, which in turn may be used to control other electronic devices. For example, when adapted for use with a midi controller, the output signal of the device may be used to control audio sources, for example, a drum machine or a keyboard module. Similarly, the device may be adapted to control a light module to coordinate lighting effects with impacts to the device.

Alternatively, the signals may be used to control electronic feedback systems, whether auditory, visual or otherwise.

In another example, the device includes: a body with a plurality of appendages; and a plurality of transducers associated with the appendages wherein the plurality of transducers are located such that a physical impact to any of the appendages activates at least one transducers to generate an output signal. It is contemplated that different output signals may be generated based on the direction of the impact to each appendage.

It is therefore an advantage of the electric Wing Chun dummy that it is able to facilitate electronically controlled output, for use in controlling associated electronic devices such as sound and/or light control modules for use in performance or for providing feedback to a user.

Additional objects, advantages and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE INVENTION

Figure 1:
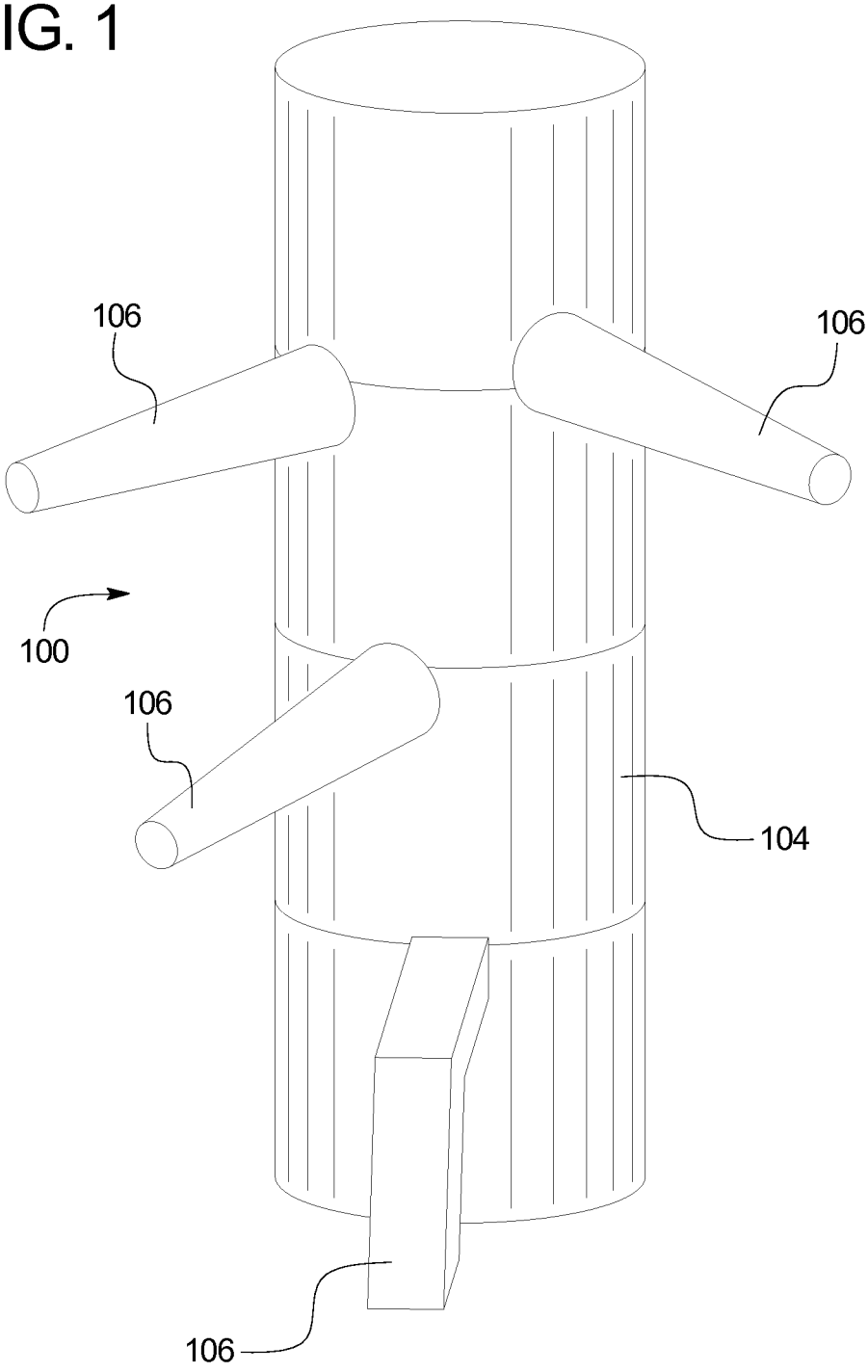
FIG. 1 is a perspective view of an Electric Wing Chun Dummy
Figure 2:
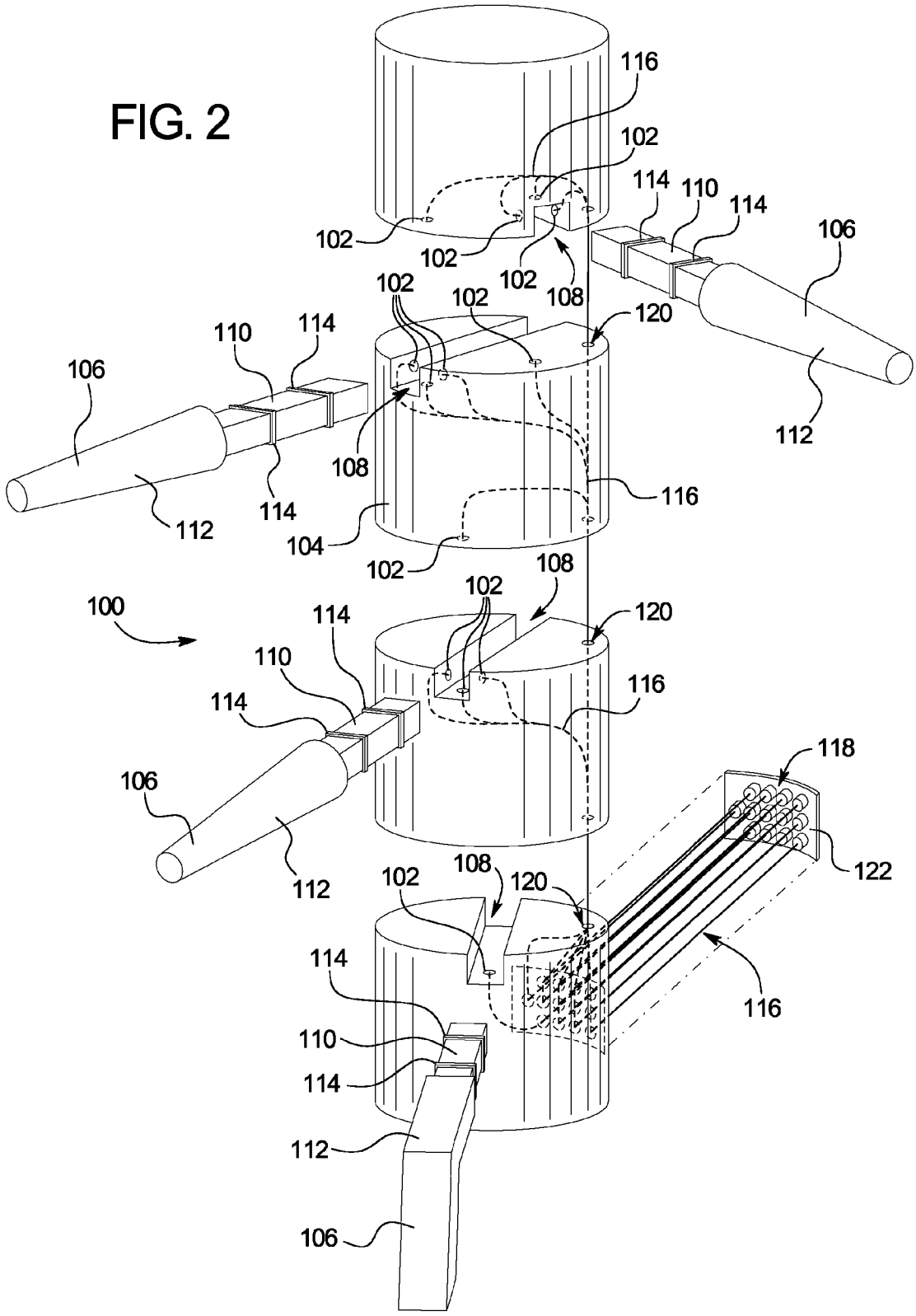
FIG. 2 is an exploded perspective view of the electric Wing Chun dummy shown in FIG. 1.

FIGS. 1 and 2 illustrate an example of an electronic device 100 embodying the invention described herein. As shown, the electronic device 100 is in the form of a Wing Chun dummy 100. As further shown, the electronic device 100 includes a plurality of transducers 102 associated a body 104 and a plurality of appendages 106. The transducers 102 are associated with the body 104 and the plurality of appendages 106 such that a physical impact to the dummy 100 activates at least one of the plurality of transducers 102 to generate an output signal.

In the example shown in FIGS. 1 and 2, the electronic device 100 is a Wing Chung dummy 100. A typical Wing Chun dummy 100 is made of wood and includes a body 104 and four appendages 106. Along the length of the body 104 of a typical Wing Chun dummy, there are four slots (or holes) 108 for receiving the appendages 106. An appendage 106 is located within each of the slots 108. Each appendage 106 extends approximately perpendicularly from the body 104. In use, the appendages 106 provide targets that may be struck by a user. The body 104 shown in FIGS. 1 and 2 is approximately forty inches long and six inches in diameter with slots 108 that are approximately one inch square. However, it is understood that the embodiment shown in FIGS. 1 and 2 is merely one example of a device 100 embodying the present invention. For example, other versions of martial arts dummies may be adapted for use as the device 100. It is further contemplated that the device 100 described herein is not limited to devices 100 embodied in martial arts related dummies, but that any body 104 and associated appendages 106 may be adapted for use as a device 100 according to the present invention. It is further contemplated that in other embodiments of the device 100, the appendages 106 may be attached to the body 104 in various positions and by various attachment mechanisms. Additionally, while the electronic device 100 shown is constructed from wood, it is contemplated that the dummy 100 may be made from another structural material such as various metals, plastics, composites, and other materials.

FIG. 2 is an exploded view of the device 100 shown in FIG. 1. As shown in FIG. 2, the appendages 106 each consist of a peg portion 110 and a striking portion 112. The peg portion 110 of each appendage 106 is inserted into a corresponding slot 106 in the body 104. As further shown, the body 104 includes a plurality of individual sections that stack to combine to form a generally cylindrical body 104. However, it is contemplated that the body 104 may be formed from any number of elements in any number of configurations.

In the example shown in FIGS. 1 and 2, the striking portion 112 of the top and middle appendages 106 is formed having a conical shape which tapers from the tip of striking portion 112 to the peg portion 110. The striking portion 112 of the top and middle section appendages 106 has an approximately circular cross-section in which the cross-sectional area decreases with the distance from the peg portion 110 to the tip of the striking portion 112. The striking portion 112 of the bottom appendage 106 has an approximately square cross-section and a downward bend along its length. While FIG. 2 illustrates one example of how the appendages 106 may be configured and attached to the body 104, it is contemplated there are numerous ways to configure the body 104 and appendages 106 and their attachment to each other.

As further shown in FIG. 2, a plurality of rubber washers 114 are placed over the peg portion 110 of each appendage 106. Placing the washers 114 over the peg portion 110 of each appendage 106 allows the appendage 106 to float within the associated slot 108. This arrangement of the appendages 106 within the slots 108 allows the appendages to dynamically react to impact and enables the operation of the transducers 102 as described further herein. However, it is understood that the washers 114 shown in FIG. 2, are merely one example of a mechanism that enables the appendages 106 to be physically responsive to impact.

As also shown in FIG. 2, a plurality piezoelectric transducers 102 are located within the slots 108 and secured to the dummy body 104. When physical contact is made to the striking portion 112 of an appendage 106, the peg portion 110 of the corresponding appendage 106 impacts one or more of the plurality of piezoelectric transducers 102 creating one or more electrical signals. Depending on the configuration of transducers 102, the signals created may be dependant upon which appendage 106 is struck and the direction in which the appendage 106 was struck.

In the example shown in FIG. 2, there are four transducers 102 associated with of the upper three appendages 106 and a single transducer 102 associated with the lowest appendage 106. As shown, there are three transducers 102 located in the body 104 in the channel 108 surrounding each of the top three appendages 106. The fourth transducer 102 associated with each of the top three appendages 106 is located in the adjacent section of the body 102. Accordingly, the upper appendages 106 may be used to generate a plurality of distinct electric signals depending on the direction of impact. It is contemplated that there may be any number of transducers 102 associated with each appendage 106 and that the transducers 102 may be positioned to react to impacts from any number of directions and may be located in either the body 104, the appendages 106 or any combination.

The signals generated by the transducers 102 are output via signal wires 116 that are electrically coupled to output connectors 118. In the example shown in FIG. 2, the signal wires 116 travel through a conduit 120 which runs the length of the device 100 to terminate at a patch bay 122, as shown in FIG. 2. As shown, the one or more signal wires 118 associated with each transducer 102 are connected to a ¼" mono output jack functioning as the output connectors 118. The output connectors 118 associated with each transducer 102 may be arranged in the patch bay 122 for output to a device (not shown) which further utilizes the signal, such as, for example, a sound or light control module.

While described above with respect to the example shown in FIGS. 1 and 2, it is contemplated that in other embodiments that the shape and orientation of the device, body 104 and appendages 106 may differ. It is further contemplated that in other embodiments that the peg portion 110 of the appendages 106 may be made suspended within the sots 108 utilizing a different material and/or method. As the purpose of the piezoelectric transducer is to convert the physical impact to an electrical signal, it is contemplated that in other embodiments of the device 100, another type of transducer with such functionality may be used. Further, it is contemplated that the number and placement of the transducers may be altered. For example, the transducers could be attached to the peg portion 110 or striking portion 112 of the appendages 106. Still further, the configuration, orientation and output of the signal wire 118 may be different. For example, the signal wire 118 may be coupled to the transducers 116 such that multiple transducers 116 lead into a single signal wire 118. Moreover, it is contemplated that the one or more electronic control modules controlled by the impact to the device 100 may be located within the body 104 or otherwise integrated within the device 100.

It should be noted that various changes and modifications to the presently preferred embodiments described herein will be apparent to those skilled in the art. Such changes and modifications may be made without departing from the spirit and scope of the present invention and without diminishing its attendant advantages.

I claim:

1. A device comprising:

a Wing Chun dummy including a vertical cylindrical body, three conically tapered appendages extending horizontally from the vertical body, and a fourth appendage including a first portion extending horizontally from the vertical body and a second portion extending downward at angle with respect to the first portion, wherein the fourth appendage is located along the vertical cylindrical body below the three conically tapered appendages; and a plurality of transducers associated with the dummy, wherein a physical impact to the dummy activates at least one of the transducers to generate an output signal, wherein the vertical body includes four stacked body sections, further wherein three of the body sections include horizontally disposed channels located along a top surface of each respective body section into which two of the conically tapered appendages and the fourth appendage are secured and wherein the fourth body section includes a horizontally disposed channel located along a bottom surface of the body section into which the third conically tapered appendage is secured.

2. The device of claim 1 wherein different output signals are generated based on a direction of the impact to the dummy.

3. The device of claim 1 wherein different output signals are generated based on a direction of the impact to at least one of the appendages.

4. The device of claim 1 wherein the transducers are located within the vertical cylindrical body.

5. The device of claim 1 further including a sound module adapted to convert the output signal to an audio signal.

6. The device of claim 1 further including a light module adapted to control one or more light sources based on the output signal.

7. The device of claim 1 wherein the plurality of transducers includes at least thirteen transducers.

8. The device of claim 1 wherein the plurality of transducers are piezoelectric transducers.

9. The device of claim 1 wherein each of the appendages includes a peg portion located within the respective channel, wherein each peg portion includes a pair of rubber washers disposed around the peg portion.

10. A device comprising:

a vertical cylindrical body;

three conically tapered appendages extending horizontally from the vertical cylindrical body, and a fourth appendage including a first portion extending horizontally from the vertical cylindrical body and a second portion extending downward at angle with respect to the first portion, wherein the fourth appendage is located along the vertical cylindrical body below the three conically tapered appendages; and a plurality of transducers associated with the appendages wherein the plurality of transducers are located such that a physical impact to any of the appendages activates at least one transducer to generate an output signal further wherein, different output signals are generated based on a direction of the impact to each appendage, wherein the vertical cylindrical body includes four stacked body sections, further wherein three of the body sections include horizontally disposed channels located along a top surface of each respective body section into which two of the conically tapered appendages and the fourth appendage are secured and wherein the fourth body section includes a horizontally disposed channel located alone a bottom surface of the body section into which the third conically tapered appendage is secured.

11. The device of claim 10 wherein the transducers are electronically coupled to a control module.

12. The device of claim 11 wherein the control module is a sound module.

13. The device of claim 11 wherein the control module is a light module.

14. The device of claim 10 wherein the vertical cylindrical body and the appendages form a Wing Chun dummy.

15. The device of claim 10 wherein the plurality of transducers are piezoelectric transducers.

16. A device comprising:

a vertical cylindrical body;

three conically tapered appendages extending horizontally from the vertical cylindrical body, and a fourth appendage including a first portion extending horizontally from the vertical cylindrical body and a second portion extending downward at angle with respect to the first portion, wherein the fourth appendage is located along the vertical cylindrical body below the three conically tapered appendages;

a plurality of piezoelectric transducers located within the vertical cylindrical body adjacent to the appendages, wherein the transducers are activated to produce an electrical output in response to an impact to the plurality of appendages; and a plurality of output connectors adapted such that each transducer is electrically coupled to a corresponding output connector such that each of the transducers produces a distinct output signal to distinct output connectors, wherein the vertical cylindrical body includes four stacked body sections, further wherein three of the body sections include horizontally disposed channels located along a to surface of each respective body section into which two of the conically tapered appendages and the fourth appendage are secured and wherein the fourth body section includes a horizontally disposed channel located along a bottom surface of the body section into which the third conically tapered appendage is secured.

17. The device of claim 16 wherein the vertical cylindrical body and appendages form a Wing Chun dummy.

18. The device of claim 17 wherein the appendages includes three arms and a leg.

19. The device of claim 18 wherein each of the three arms is associated with four transducers and the leg is associated with one transducer.

* * * * *